US010184289B2

(12) United States Patent
Thompson

(10) Patent No.: US 10,184,289 B2
(45) Date of Patent: Jan. 22, 2019

(54) SPACER KEY FOR HOLLOW SPACER SECTIONS

(71) Applicant: APOGEE ENTERPRISES, INC., Minneapolis, MN (US)

(72) Inventor: Aaron Thompson, Owatonna, MN (US)

(73) Assignee: APOGEE ENTERPRISES, INC., Minneapolis, MN (US)

( * ) Notice: Subject to any disclaimer, the term of this patent is extended or adjusted under 35 U.S.C. 154(b) by 0 days.

(21) Appl. No.: 15/601,300

(22) Filed: May 22, 2017

(65) Prior Publication Data

US 2017/0342766 A1 Nov. 30, 2017

Related U.S. Application Data

(60) Provisional application No. 62/341,957, filed on May 26, 2016.

(51) Int. Cl.
*E06B 3/667* (2006.01)
*E06B 3/663* (2006.01)

(52) U.S. Cl.
CPC ..... *E06B 3/667* (2013.01); *E06B 3/66314* (2013.01)

(58) Field of Classification Search
CPC ..... E06B 3/667; E06B 3/663; E06B 3/66352; E06B 3/66357; E06B 3/66315;
(Continued)

(56) References Cited

U.S. PATENT DOCUMENTS 3,321,223 A * 5/1967 Snow ..... E06B 3/9682 312/140
4,683,634 A * 8/1987 Cole ..... E06B 3/667 29/412

(Continued)

FOREIGN PATENT DOCUMENTS

CA 2461722 A1 4/2003
DE 29722771 U1 6/1999

(Continued)

OTHER PUBLICATIONS

International Search Report for International Patent Application No. PCT/US2017/033773, dated Jul. 7, 2017 (4 pages).

(Continued)

*Primary Examiner* — Amber R Anderson
*Assistant Examiner* — Nahid Amiri
(74) *Attorney, Agent, or Firm* — Dorsey & Whitney LLP

(57) ABSTRACT

A disclosed spacer key is configured for insertion within hollow spacer sections, thereby connecting the hollow spacer sections. The spacer key may include a top wall and a bottom wall connected by opposing side walls such that the spacer key has a tubular cross section and longitudinally-extending body. To control how much of the body is inserted into each spacer section, one or more raised areas may be included on the exterior of the spacer key. Protrusions may extend laterally-outward from the spacer key, configured to contact one or more internal surfaces of surrounding spacer sections upon insertion. External surfaces of the spacer key lacking protrusions may include one or more depressed areas. Longitudinally-extending grooves may also be included on the exterior of the spacer key to accommodate various perforations that may protrude from surrounding spacer sections, thereby improving the fit between the spacer key and spacer sections.

18 Claims, 12 Drawing Sheets

(58) Field of Classification Search
CPC ..... E06B 3/66; E06B 3/67326; Y10T 403/55553; Y10T 403/7026; Y10T 403/7035
USPC ..... 52/786.13, 656.9, 586.1, 586.2; 403/292, 403/293, 359.1, 359.2
See application file for complete search history.

(56) References Cited

U.S. PATENT DOCUMENTS

| | | | | |
|---|---|---|---|---|
| 5,048,997 | A * | 9/1991 | Peterson | E06B 3/667 403/295 |
| 5,099,626 | A * | 3/1992 | Seeger | E06B 3/6675 52/204.593 |
| 6,244,012 | B1 * | 6/2001 | McGlinchy | E06B 3/667 403/247 |
| 6,862,859 | B2 | 3/2005 | Kronenberg | |
| 6,896,440 | B2 | 5/2005 | Zurn et al. | |
| 6,938,388 | B2 | 9/2005 | Bayer | |
| 7,070,356 | B2 | 7/2006 | Kronenberg et al. | |
| 7,124,546 | B2 * | 10/2006 | Scharff | E06B 3/6604 52/314 |
| 7,757,455 | B2 * | 7/2010 | Gallagher | E06B 3/667 52/204.705 |
| 7,908,820 | B2 | 3/2011 | Catalano et al. | |
| 7,987,577 | B2 | 8/2011 | Lenhardt | |
| 8,001,742 | B2 * | 8/2011 | Briese | E06B 3/667 403/201 |
| 8,015,763 | B2 * | 9/2011 | McGlinchy | E06B 3/667 52/204.61 |
| 8,240,107 | B2 * | 8/2012 | Gallagher | E06B 3/667 403/270 |
| 8,240,940 | B2 | 8/2012 | Strohheker | |
| 8,307,596 | B2 * | 11/2012 | Catalano | E06B 3/667 52/456 |
| 8,381,481 | B2 | 2/2013 | Lenhardt | |
| 8,615,883 | B2 | 12/2013 | Lenhardt et al. | |
| 8,869,494 | B2 | 10/2014 | Mader | |
| 9,074,417 | B2 | 7/2015 | Cooper et al. | |
| 2002/0102127 | A1 | 8/2002 | Loh et al. | |
| 2007/0022700 | A1 * | 2/2007 | Gallagher | E06B 3/667 52/656.9 |
| 2009/0107085 | A1 * | 4/2009 | Catalano | E06B 3/667 52/786.13 |
| 2014/0000191 | A1 | 1/2014 | Snyker et al. | |

FOREIGN PATENT DOCUMENTS

| | | | | |
|---|---|---|---|---|
| DE | 29913903 | U1 * | 11/1999 | E06B 3/667 |
| DE | 102008023796 | A1 * | 11/2008 | E06B 3/667 |
| DE | 202012103904 | U1 | 2/2014 | |
| EP | 1911924 | A3 * | 12/2010 | E06B 3/667 |
| WO | 2008119461 | A1 | 10/2008 | |
| WO | 2014004871 | A1 | 1/2014 | |

OTHER PUBLICATIONS

Written Opinion of the International Searching Authority for International Patent Application No. PCT/US2017/033773, dated Jul. 7, 2017 (6 pages).

* cited by examiner

SPACER KEY FOR HOLLOW SPACER SECTIONS

CROSS-REFERENCE TO RELATED APPLICATION

This application claims benefit under 35 U.S.C. § 119 of the earlier filing date of U.S. Provisional Application No. 62/341,957, filed May 26, 2016, entitled "SPACER KEY FOR HOLLOW SPACER SECTIONS," which is hereby incorporated by reference in its entirety as if fully set forth herein.

TECHNICAL FIELD

The present invention relates to spacer keys for hollow spacer sections. More particularly, the present invention provides spacer keys with external protrusions that connect adjacent hollow spacer sections of insulating window units such that the force required to separate them is increased. The spacer keys have a tubular cross-sectional design and feature longitudinal grooves on an external surface.

BACKGROUND

Insulating glass units typically comprise double-paned glass windows separated by longitudinally-extending spacer units. Variously shaped and comprised of assorted materials, spacer units typically line the perimeter of glass windows where they provide structural support between adjacent panes of glass. Instead of providing one elongated spacer unit of customized length and shape for each individual window design, spacers are typically manufactured in sections that are later connected together end-to-end upon window assembly, forming an insulating frame around a window perimeter. Connector pieces, called "spacer keys," may be used to secure adjacent spacer sections together and enhance the insulating capacity of double-paned glass units. Thus, spacer keys serve as structural links affixing one spacer section to the next.

Improved binding between the exterior of the spacer keys and the interior of the spacer sections may increase the force required to separate adjacent spacer units in a longitudinal direction. Preexisting spacer keys comprise different external features for connecting spacer sections; however, these designs often fail to provide the resistance necessary to prevent the spacer sections from separating. For instance, current metal spacer keys ineffectively bind the interior of spacer sections comprised of materials having similar hardness levels, resulting in loosely-connected spacer units susceptible to separation. In addition to inadequate binding, other preexisting spacer keys lack the features necessary to accommodate numerous design features incorporated into current spacer sections. For example, spacer keys may deform spacer sections near their connection points by failing to accommodate internally-protruding perforations in the spacer sections, creating undesirable distortions. Furthermore, preexisting spacer keys are frequently comprised of materials incapable of shielding insulation units from contamination. Novel spacer keys with versatile design features and improved connection means are thus needed to enhance the effectiveness of insulating glass units.

SUMMARY

In some embodiments, a spacer key for hollow spacer sections may include a tubular cross section and longitudinally-extending body configured for insertion within two adjacent hollow spacer sections, thereby connecting the spacer sections. The spacer key may be comprised of one or more materials, including polymers, and may include a top wall and a bottom wall connected by opposing side walls, thereby forming a body that may be straight, angled, curved and/or longitudinally-symmetrical. A plurality of laterally-outward extending protrusions may be positioned on the exterior of the longitudinally-extending body. The spacer key may include one or more grooves, such as longitudinally-extending grooves, on the exterior of the top wall; one or more raised areas configured to engage with each of the adjacent hollow spacer sections to control how much of the body is inserted into each of the spacer sections, and one or more exterior depressed areas each defined by an absence of protrusions.

In some embodiments, the protrusions may be positioned on one or more opposing side walls of the spacer key, where they may be configured to increase a frictional force between the interior of a spacer section and the protrusions. The protrusions may bend or flex upon insertion into a spacer section and may vary in size, shape, orientation, and/or arrangement. The protrusions may be uniformly sized or progressively longer or shorter with increasing distance from the longitudinal middle of the spacer key body. The protrusions may extend from the spacer key at about a perpendicular angle and/or may each include a base portion and a tip portion. In some embodiments, the protrusions may be arranged in longitudinally-extending rows that may span only a portion or the entire length of the longitudinally-extending body. Such rows may be uniformly spaced with respect to each other or progressively closer together or further apart with increasing distance away from the longitudinal middle of the spacer key.

In some embodiments, the tubular cross section of the spacer key may define an internal hollow space configured to receive one or more desiccant materials. Such hollow space may include a channel that extends the entire length of the longitudinally-extending body.

In some embodiments, the depressed areas of the spacer key may be positioned on one or more external surfaces of one or more side walls. The depressed areas may have a flat surface. After insertion into adjacent spacer sections, the depressed areas may align with a splice joint, where they may define an interstitial space between the spacer key and the interior of the adjacent spacer sections. Such interstitial space may be configured to receive sealant materials.

In some embodiments, the longitudinally-extending grooves of the spacer key may extend the entire length of the longitudinally-extending body. The grooves may be configured to accommodate outwardly-protruding perforations on hollow spacer sections. Some embodiments may include a desired number of grooves, such as, for example, two grooves.

DETAILED DESCRIPTION

Provided herein are improved spacer keys designed to connect hollow spacer sections by enhancing the frictional contact between the two components. For instance, the spacer keys disclosed herein feature a plurality of external protrusions that contact the internal surface of hollow spacer sections to provide removal resistance after assembly. The dimensions and angle at which the protrusions extend outwardly from the spacer key body increase the force required to separate spacer units after assembly without significantly increasing the force required to connect spacer units during assembly. The spacer keys disclosed herein also comprise external grooves to accommodate perforations in the spacer sections, one or more external, depressed surface areas for sealant fill, and an internal channel for desiccant flow.

Figure 1:
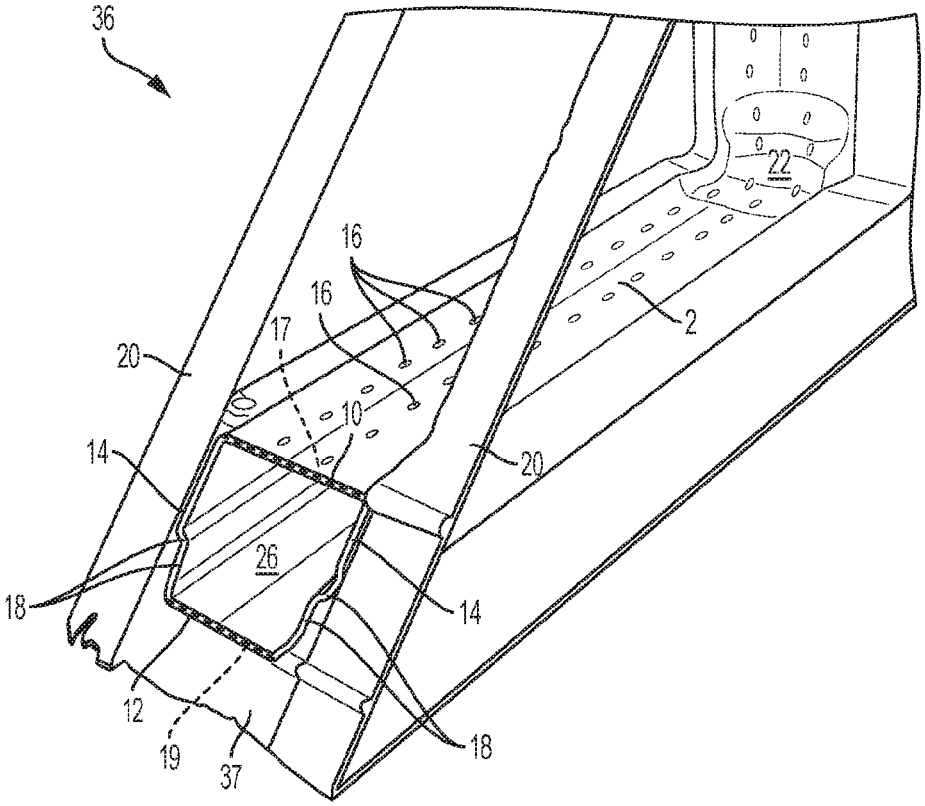
FIG. 1 is perspective cross-sectional view of an insulating glass unit, showing two panes of glass and spacer sections positioned between them.

Referring to the drawings, FIG. 1 shows an assembled insulating glass unit 36. The insulating glass unit 36 may comprise two glass panes 20 arranged parallel to each other. Positioned between the glass panes 20 are one or more spacer sections 2. A plurality of spacer sections 2 may be connected end-to-end to form a frame around the perimeter of the insulating glass unit 36. Various outer sealants 37 may surround up to three sides of each spacer section 2 to hermetically seal the insulating glass unit 36. Outer sealants 37 may include but are not limited to silicone, polyurethane, polysulphide and/or various synthetic rubbers, e.g., polyisobutylene.

As depicted in FIG. 1, each spacer section 2 may comprise a tubular cross-section featuring a top piece 10, two side pieces 14, and a bottom piece 12 arranged to define a hollow space 26. The external surface of the top piece 10 faces the interior of the insulating glass unit 36 and may thus remain visible after assembly. As shown, the top piece 10 may extend substantially from one glass pane 20 to an adjacent glass pane 20, positioned perpendicularly with respect to the surface plane of each pane after assembly. Accordingly, the width 17 of the top piece 10 may define the space between two panes of glass 20 in an insulating glass unit 36. The width 17 of each spacer section 2 may be adjusted depending on the desired separation between the glass panes 20. In some embodiments, the width 17 may range from about 0.125 to about 1.5 inches, about 0.25 to about 1.25 inches, about 0.25 to about 1.0 inches, about 0.25 to about 0.35 inches, about 0.35 to about 0.40 inches, about 0.40 to about 0.45 inches, about 0.45 to about 0.55 inches, about 0.55 to about 0.60 inches, about 0.60 to about 0.65 inches, about 0.70 to about 0.80 inches, about 0.85 to about 0.90 inches, or about 0.95 to about 1.05 inches. It should be noted that, for all of the dimensional, density, and other values provided herein (including but not limited with respect to FIG. 1), values above, within, or below those provided may be used, and the invention is not to be limited to any particular dimensions or values.

The side pieces 14 of the spacer section 2 extend downward, in parallel fashion with respect to each other and the glass panes 20, forming an approximately right angle with respect to the lateral edges of top piece 10. While the portions of the side pieces 14 proximal to the top piece 10 may be approximately perpendicular to the top piece 10, the side pieces 14 may each taper inwardly beginning at a certain distance from top piece 10, defining a tapered portion 18 on each side piece 14 that extends to the bottom piece 12. Accordingly, the bottom piece 12 may comprise a width 19 that is shorter than the width 17 of the top piece 10. The tapered portion 18 on each side piece 14 creates space between the external surface of the spacer section 2 and the internal surface of the glass panes 20 so that outer sealants 37 may surround up to three sides of each spacer section 2. In alternative embodiments, not shown, the spacer section 2 may lack one or more tapered portions 18, such that the side pieces 14 extend from the top piece 10 to the bottom piece 12. In such embodiments, widths 17 and 19 may be approximately equal, and the tubular cross-section of the spacer section 2 may be rectangular or square-shaped.

The top piece 10 may feature a plurality of longitudinally-spanning perforations 16. The perforations 16 may span the entire length of each spacer section 2. Alternatively, the perforations may span only a portion of each spacer section 2. The perforations may exist in two parallel rows, as shown in FIG. 1, with the perforations 16 equally spaced relative to each other. In other embodiments, each top piece 10 may feature only one row of perforations 16. Alternatively, the perforations 16 may not be arranged in rows. Such embodiments may feature, for example, pairs of perforations 16 near the end of each spacer section 2. In other embodiments, the perforations 16 may be arranged irregularly with respect to each other and/or each spacer section 2. The perforations 16 may cover variously-shaped and/or sized portions of the top piece 10. In some embodiments, the perforations 16 may be clustered in distinct surface areas spanning the length of each spacer section 2. In one embodiment, the surface area defined by the perforations 16 may cover the majority of top piece 10.

Each spacer section 2 may be comprised of one or more metals, e.g., stainless steel, electronically galvanized steel, and/or aluminum. Alternatively, each spacer section 2 may be comprised of fiberglass, plastics, foam, polyvinyl chloride, vinyl, wood, and/or one or more biopolymers. Different materials may be used for differently-shaped spacer sections 2. For example, longitudinally-straight spacer sections may be comprised of a material distinct from that used to construct bent, curved, or angled spacer sections 2. Different materials may also be used for different pieces of each spacer section 2. For example, the top piece 10 may be comprised of a plastic, while the side pieces 14 and bottom piece 12 may be comprised of stainless steel.

Figure 2:
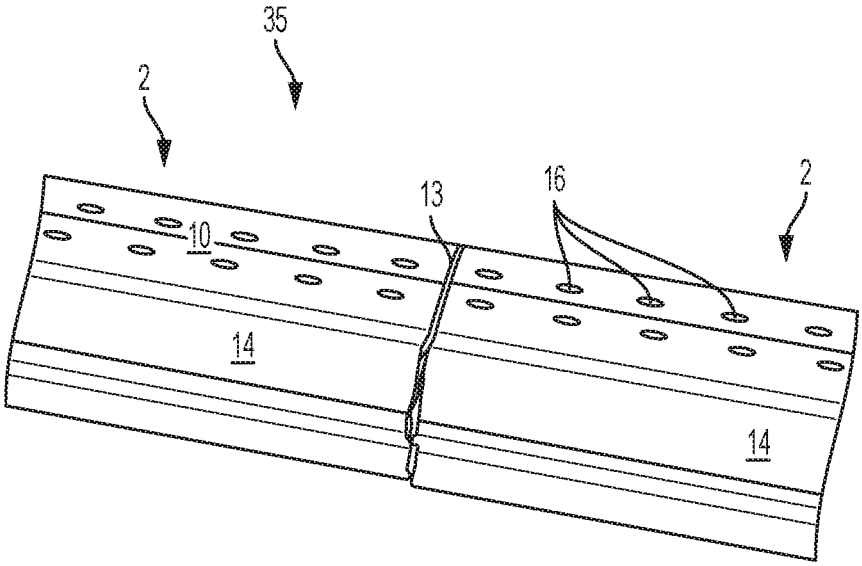
FIG. 2 is a perspective view near a splice joint of two adjacent spacer sections after assembly.

FIG. 2 depicts a side view of two hollow spacer sections 2 connected together end-to-end. The interface between adjacent spacer sections 2 may comprise a splice joint 13. The spacer sections 2 are connected via an internally-positioned spacer key at the splice joint 13. In addition, various sealant materials 27 may be injected in a lateral space between the spacer key 1 and the surrounding spacer sections 2 at the splice joint 13. Two spacer sections 2 connected end-to-end via an internally-positioned spacer key 1 comprises an assembled spacer unit 35.

Figure 3:
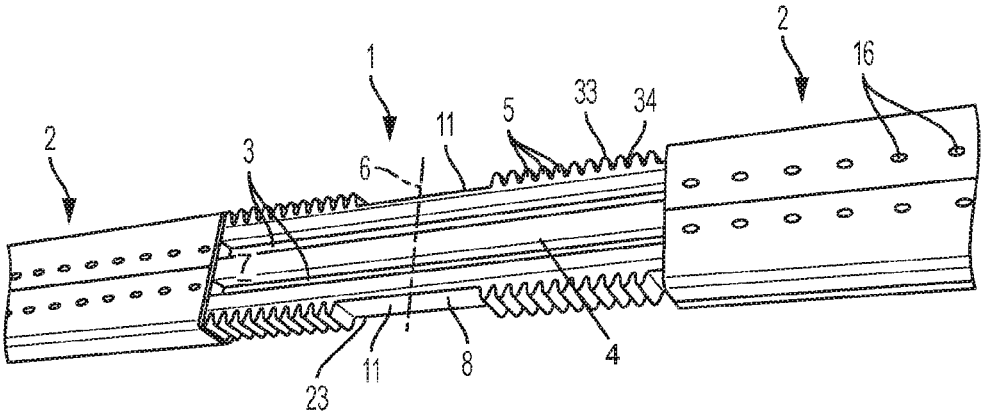
FIG. 3 is a perspective view of the top of a spacer key in one embodiment of the invention being slidably inserted within two spacer sections during assembly.

As shown in FIG. 3, an assembled spacer unit 35 may be formed by slidably inserting a spacer key 1 in one embodiment of the invention within two spacer sections 2. The spacer key 1 may be designed as an elongated, straight connector piece with a body 4 designed to fit within a hollow spacer section 2. In preferred embodiments, the spacer key 1 is longitudinally symmetrical relative to the middle 6 of the spacer key body 4. In other embodiments, not shown, the spacer key 1 may be asymmetrical. In addition or alternatively, the spacer key 1 may comprise an angled or curved body configured to fit within spacer sections similarly angled or curved. Such variations in the shape of the body 4 may be necessary to accommodate curved windows or corners 22, depicted in FIG. 1. According to such embodiments, the portions of the body 4 extending in different directions away from corner 22 may be arranged at various angles with respect to one another.

The spacer key 1 may feature one or more longitudinally-extending grooves 3 on the exterior surface of the top wall 7. In the embodiment shown in FIG. 3, the spacer key 1 features two longitudinally-extending grooves 3. The grooves 3 are positioned to accommodate longitudinally-extending perforations 16 that protrude inwardly from the top piece 10 of each spacer section 2, such that the perforations 16 slide into the grooves 3 upon insertion of the spacer key 1 within the hollow space 26 of the spacer section 2. By receiving the perforations 16, the grooves 3 prevent distortion of the top piece 10 near the splice joint 13, where the snug fit between the spacer sections 2 and spacer keys 1 upon assembly of each spacer unit 35 might otherwise interfere with the inward projection of the perforations 16. The grooves 3 may span the entire length of the body 4. Alternatively, the grooves 3 may only span a portion of the body 4. The depth of the grooves 3 may be substantially similar or slightly greater than the height of the perforations 16. In some embodiments, the depth of the grooves 3 may range from about 0.01 to about 1.0 mm, about 0.05 to about 0.5 mm, about 0.1 to about 0.3 mm, or about 0.15 to about 0.25 mm. The lateral width of the grooves 3 may also be substantially similar or slightly greater than the lateral width of the perforations 16. In some embodiments, the lateral width of each of the grooves 3 may range from about 0.01 to about 15.0 mm. The shape of the grooves 3 may also vary to accommodate any arrangement of perforations 16 on a corresponding spacer section 2. For example, the grooves may be curved, rounded, square, or may comprise a pointed tip at or near a bottom surface. In alternative embodiments, the two longitudinally-extending grooves 3 shown in FIG. 3 may be replaced with one groove of greater width. In other embodiments, the grooves may extend to the edge of the top wall 7, defining a longitudinally-extending, elevated portion near the lateral center of the top wall 7.

The spacer key 1 may also feature one or more depressed areas 11 that may be configured to define a more narrow section of the body 4. Positioned on one or more external surfaces of one or more side walls 8 of the spacer key 1, the depressed areas 11 preferably span the middle 6 or center portion of the body 4. In the embodiment shown in FIG. 3, the depressed areas 11 comprise a substantially flat surface area. In other variants, not shown, the depressed areas 11 may not be flat. In such embodiments, one or more depressed areas 11 may feature grooves or various surface textures, e.g., bumps. The shape of the depressed areas 11 also may vary. For instance, the depressed areas 11 may be approximately circular or oval-shaped. In other embodiments, such as that shown in FIG. 3, the depressed areas may be substantially rectangular in shape. The depressed areas 11 may also vary in size. For example, FIG. 3 depicts a depressed area 11 with a length that spans the distance between two rows of protrusions 5, and a width defined by the top wall 7 and an indentation 23 in the side wall 8 of the spacer key 1. In other embodiments, one or more depressed areas 11 may comprise smaller or larger surface areas. In some embodiments, the protrusions 5 may occupy the entire length of the spacer key 1 such that a depressed area is entirely absent from the spacer key 1.

In some embodiments, one or more raised areas, e.g., tabs, may also be positioned on one or more external surfaces of the spacer key 1 to ensure only a desired portion, for example not more than half, of the body 4 is inserted into each spacer section 2. The one or more raised areas may thus serve as physical stops configured to engage with surrounding spacer sections 2 to maintain a desired alignment between the two components, such that in one embodiment the one or more depressed areas 11 overlap with the splice joint 13. In some embodiments of the invention, the one or more raised areas may be positioned at or near the longitudinal middle 6 of the body 4. In some embodiments, the raised areas may be present on each external surface of the spacer key 1. In addition or alternatively, each raised area may be connected such as to form a single raised area that spans the entire perimeter of the body 4. The raised areas may comprise various shapes and materials, and may limit the insertion depth of each spacer key 1 according to different mechanisms. For example, one or more raised areas may prevent over-insertion of the spacer key 1 by exerting a pressure on one or more internal surfaces of the surrounding spacer sections 2. In another embodiment, the raised areas may engage with each spacer section 2 by engaging with an edge of a spacer section 2. In other embodiments, the raised areas may be configured to engage with each spacer section 2 via a lock/pin mechanism. Embodiments may feature rectangular, rounded, jagged, hooked, angled, cantilevered, columnar, rod-like and/or bent raised or other areas that extend away from one or more surfaces of the body 4. Such raised areas may be rigid, elastic, flexible, retractable, and/or spring loaded, or they may be configured in other manners.

FIG. 3 also shows laterally-outward extending protrusions 5 in one embodiment of the invention that flank each of the depressed areas 11. The protrusions 5, which may be ribs or fins, are designed to firmly contact one or more interior surfaces of a surrounding spacer section 2 and are adapted to flex upon assembly of each spacer unit 35. The protrusions 5 retain the spacer key 1 within surrounding spacer sections 2 and increase the force required to separate adjacent spacer sections 2. In a preferred embodiment, the protrusions 5 may be positioned on one or more external surfaces of one or more side walls 8, from which they protrude laterally outward.

The size and/or shape of each of the protrusions 5 may vary. The protrusions 5 shown in FIG. 3 comprise ribs approximately triangular in shape when viewed from the top of the spacer key 1 such that the thickness of each of the protrusions 5 is the greatest near their base 34. In such embodiments, the thickness of each of the protrusions 5 decreases as it extends away from the surface of one or more side walls 8 to define a rounded tip 33. The tip 33 may also be more sharply defined, e.g., V-shaped. Alternatively, each of the protrusions may be configured to lack a tip portion, or may comprise a greater thickness at the tip than at the base. In other embodiments each of the protrusions 5 may be rectangular, rod-like, jagged, knob-like, or wave-like in shape. Other protrusions 5 may be configured to resemble bristles, for example. Individual protrusions 5 may be symmetrical or irregular. The thickness of the protrusions 5 may also vary. In some embodiments, the thickness may be increased where increased rigidity is desired. The thickness may also be decreased in embodiments where the number and/or density of protrusions 5 is increased, for example.

Figure 4:
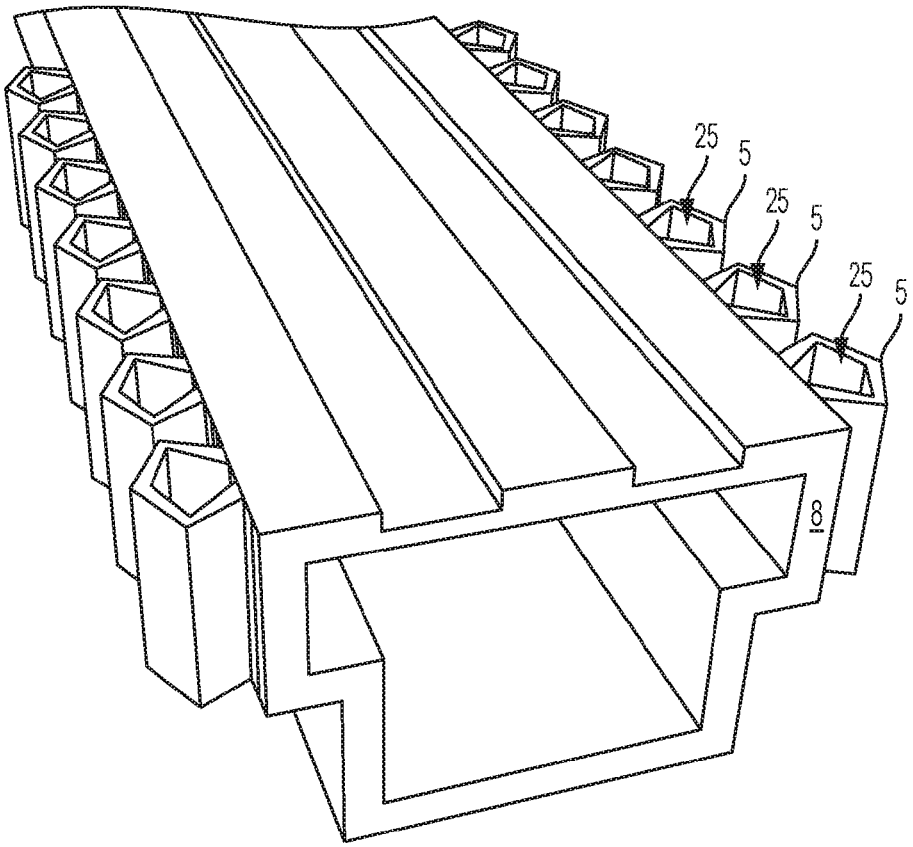
FIG. 4 is a perspective view of a spacer key in one embodiment of the invention.

FIG. 4 depicts an embodiment comprising tubular protrusions 5 or fins. As shown, the protrusions 5 each define a generally vertically-extending hollow space 25 (which may be pentagonal or any other desired configuration) defined by four walls and a portion of a side wall 8. In other embodiments, the hollow space 25 defined by similarly tubular protrusions 5 may be variously sized and/or shaped. For example, the cross-sectional shape of tubular protrusions 5 may be approximately rectangular, triangular, circular, semicircular, elliptical, and/or rounded. In other embodiments, the hollow space 25 may comprise narrow slits. Additional embodiments may feature numerous hollow spaces 25 defined by each protrusion 5. The hollow space 25 may span the entire length of each protrusion 5 or only a portion thereof. The hollow space 25 may be configured to deform and/or compress upon insertion of the spacer key 1 into surrounding spacer sections 2. In such embodiments, the cross-sectional width of the protrusions, viewed from a top side, may increase upon insertion into surrounding spacer sections 2.

One embodiment of the invention may include protrusions 5 that extend outward from the surface of each of the side walls 8 such that a frictional and/or compressive force is exerted against the protrusions 5 upon their insertion within a spacer section 2. These forces may, but need not necessarily, cause each of the protrusions 5 to bend, flex, deform, and/or compress. In one embodiment, the protrusions 5 flex toward the middle 6 as the spacer key 1 is slidably inserted within a spacer section 2. In another embodiment, such as that depicted in FIG. 4, the cross-sectional shape of each of the protrusions 5 may deform or compress to accommodate such forces in addition to or instead of flexing toward the middle 6. The distance at which the protrusions 5 extend outwardly from the surface of the side walls 8 may vary. In some embodiments, the protrusion length may range from about 0.1 to about 10 mm, about 0.1 to about 5 mm, about 0.5 to about 3 mm, about 0.75 to about 3 mm, or about 1 to about 2 mm. In one embodiment, the protrusion length may be uniform for each of the protrusions 5 on the same spacer key 1. In other embodiments, the protrusions 5 on a given spacer key 1 may comprise various lengths. In some embodiments, the length of the protrusions 5 may increase or decrease at increasing distances from the middle 6.

The protrusions 5 may be organized in various arrangements with respect to the body 4 of the spacer key 1 and/or with respect to one another. The arrangements may be patterned or irregular and may span all or a portion of one or more of the side walls 8. In the embodiments shown in FIGS. 3 and 4, the protrusions 5 are arranged in longitudinally-extending rows. In other embodiments, the protrusions 5 may be arranged diagonally with respect to one or more surfaces of the body 4. The protrusions 5 are preferably positioned on each of the side walls 8, but absent from the one or more depressed areas 11 encompassing the middle 6. In an alternative embodiment, the protrusions 5 may extend across the middle 6, effectively eliminating at least a portion of the one or more depressed areas 11. In such embodiments, the protrusions 5 may span the entire length of each of the side walls 8 from which they protrude. In addition to one or more side walls 8, the protrusions 5 may also be positioned to extend from the top wall 7, the bottom wall 9, and/or one or more corners between the various walls. In one embodiment, the protrusions 5 may be positioned over the corner between the top wall 7 and one or more side walls 8, extending for a distance on the top wall 7. In addition or alternatively, the protrusions 5 may be positioned on one more side walls and between the grooves 3 on the top wall 7. Protrusions 5 extending from different surfaces of the spacer key 1 may be shaped and/or sized differently or the same. For example, protrusions 5 positioned on the top wall 7 may be shorter in length than protrusions 5 extending from one or more side walls 8.

Relative to each other, the protrusions 5 may be uniformly spaced in the longitudinal direction, as shown in FIGS. 3 and 4. In additional variants, the protrusions 5 may be scattered and unequally-spaced over one or more surfaces of the spacer key 1. In still other embodiments, the protrusions 5 may be more abundant over localized areas. For example, in one embodiment, the protrusions 5 may be spaced progressively closer together or further apart with increasing distance away from the longitudinally middle 6. Accordingly, the total number of protrusions 5 on each spacer key 1 may also vary. In some embodiments, the total number of protrusions 5 may range from about 1 to about 500, about 10 to about 250, about 30 to about 100, about 45 to about 75, about 55 to about 65, about 58 to about 62 protrusions, or any suitable number of protrusions. In various embodiments, the number of protrusions 5 may be altered as necessary to cover differently-sized spacer keys, modify the separation resistance between adjacent spacer sections, adjust the sealant capacity, and/or accommodate different spacer unit designs.

The protrusions 5 may comprise a number of suitable materials. The materials may be flexible, elastic, or rigid. Variations in the composition of the protrusions 5 may be necessary to increase or decrease their rigidity. In one embodiment, the protrusions 5 may be comprised of the same or similar material as the spacer key body 4, for example, one or more polymers, thermoplastics, metals or rubbers. In other embodiments, the protrusions 5 may be comprised of material distinct from the material comprising the body 4, for example, one or more metals. As noted, the protrusions 5 may be formed integrally with a spacer key body 4, and/or they may be positioned on or secured within or to the body 4.

Figure 5:
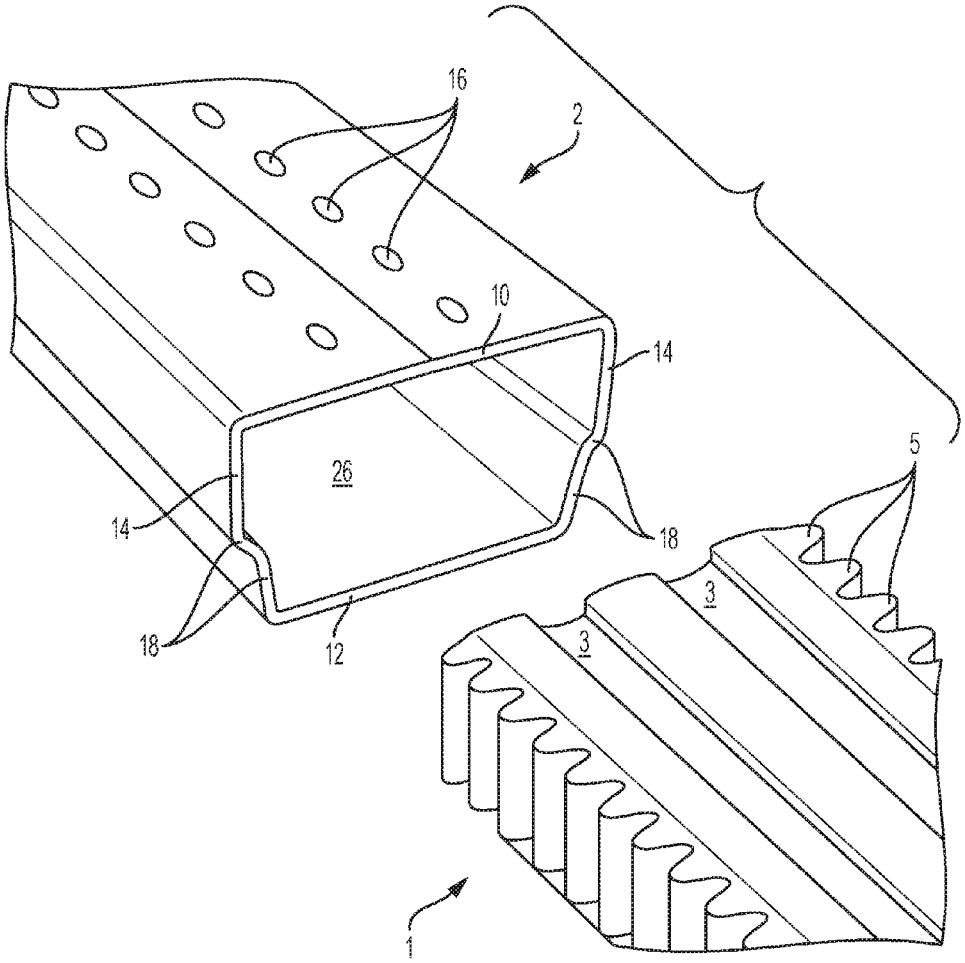
FIG. 5 is a perspective view of a hollow spacer section and a corresponding spacer key in one embodiment of the invention prior to assembly.

FIG. 5 shows a hollow spacer section 2 and a corresponding spacer key 1 in one embodiment of the invention prior to assembly. As shown, the hollow space 26 is configured to receive the spacer key 1. The grooves 3 on the top of the spacer key 1 align with rows of longitudinally-extending perforations 16, and the protrusions 5 are positioned to contact one or more internal surfaces of the spacer section side pieces 14.

Figure 6:
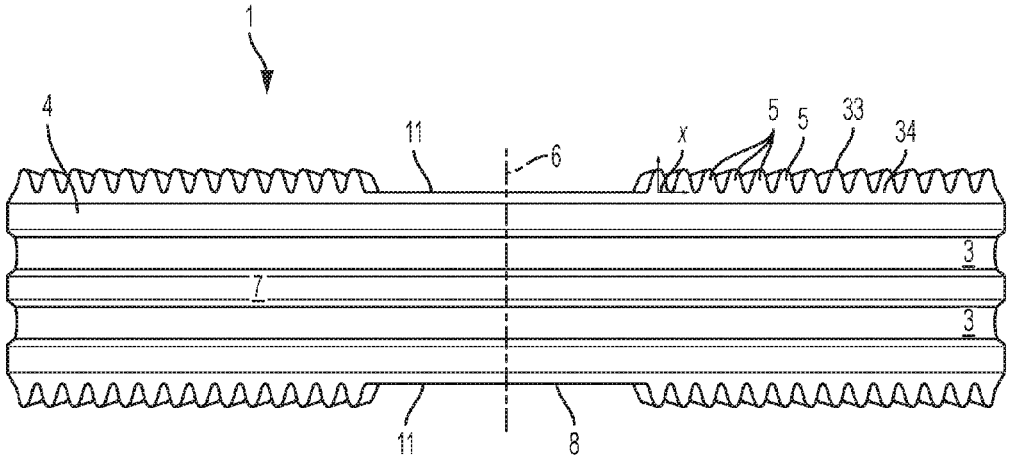
FIG. 6 is a top view of a spacer key in one embodiment of the invention.

FIG. 6 illustrates an exemplary top view of a spacer key 1 in one embodiment of the invention. As shown, the spacer key 1 may be longitudinally symmetrical about the middle 6. The grooves 3 on the top wall 7 may each extend the entire length of the spacer key 1. Depressed areas 11 marked by an absence of protrusions 5 may be included on each of the side walls 8, defining a more narrow section of the spacer key 1. Alternatively, one or zero side walls 8 may comprise a depressed area 11.

Numerous protrusions 5 extend laterally-outward from the surface of the side walls 8, arranged in rows that may extend from the outer edge of each of the depressed areas 11 to each end of the spacer key 1. Alternatively, the protrusions 5 may cover only a portion of each side wall surface between one or more depressed areas 11 and one or more ends of the spacer key 1. Accordingly, the size of each of the depressed areas 11 may vary depending on the number of protrusions 5 included on one or more side walls 8. As shown, the rows of protrusions 5 may be generally regularly spaced. In other embodiments, the rows may not be equally spaced. For example, the rows may be spaced such that they are progressively closer together or further apart with increasing distance away from the longitudinal middle 6 of the spacer key 1. The top wall 7 depicted in FIG. 6 comprises no protrusions 5. In alternative embodiments, one or more protrusions 5 may be included on the top wall 7. Each of the protrusions 5 may extend outwardly at angle x, which represents an angle of one or more protrusions 5 prior to insertion of the spacer key 1 into one or more spacer sections 2. As shown, angle x may be approximately 90° with respect to the surface of one or more side walls 8. In other embodiments, angle x may be greater than or less than 90°. For example, measured relative to the surface of one or more side walls, from the closest end of the spacer key 1 to the middle 6, angle x may range from about 1 to about 179°, about 1 to about 90°, about 10 to about 80°, about 20 to about 70°, about 30 to about 60°, about 40 to about 50°, about 80 to about 100°, about 70 to about 110°, about 60 to about 120°, about 90 to about 179°, about 100 to about 170°, about 110 to about 160°, about 120 to about 150°, or about 130 to about 140°.

The spacer key 1 may comprise various lengths depending on the size and/or shape of the surrounding spacer sections. In some embodiments, the length may range from about 1 to about 24 inches. Similarly, the width of the spacer key 1 may vary as necessary to fit differently-sized spacer sections. In various embodiments, the width may range from about 0.05 to about 1.5 inches.

Figure 7:
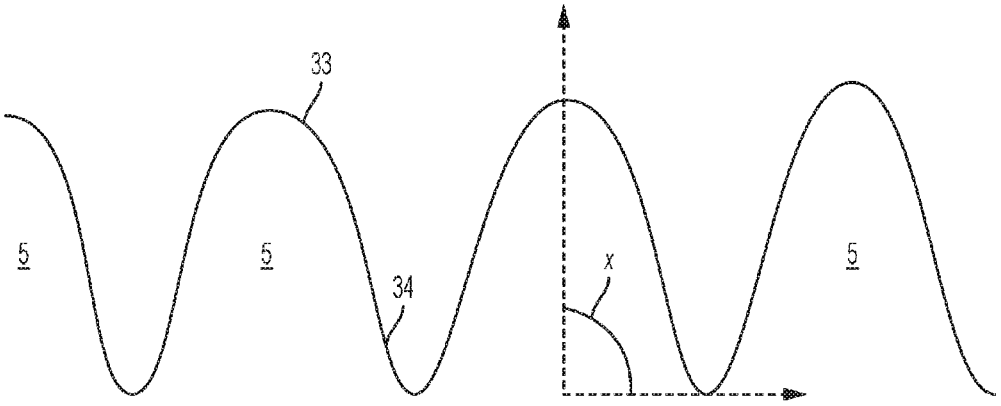
FIG. 7 is a close-up view of protrusions on a spacer key in one embodiment of the invention.

FIG. 7 shows exemplary close-up top view of protrusions 5 in one embodiment of the invention. As shown, the protrusions 5 may comprise a rounded tip 33 and a base 34. The specific angle x formed by each of the protrusions 5 and the surface of the side walls 8 may vary. In a preferred embodiment, each of the protrusions 5 points in a direction approximately perpendicular to the external surface of the wall from which it protrudes. In other embodiments, angle x may be more or less than about 90° depending on the force desired for assembly and/or disassembly. For example, by angling the protrusions 5 to point toward the middle 6, the force required to insert the spacer key 1 within a corresponding spacer section 2 may be less in comparison to perpendicularly-angled protrusions 5. Alternatively, the protrusions 5 may be angled away from the middle 6 such as to increase the force required for assembly. According to such embodiments, the protrusions 5 may be configured to flex in the opposite direction, i.e., toward the middle 6, upon insertion within one or more surrounding spacer sections 2.

Angle x may be generally uniform for each of the protrusions 5 on a given spacer key 1. Alternatively, variously-angled protrusions 5 may be positioned on the same spacer key 1. In one such embodiment, for example, protrusions 5 positioned on opposite sides of the middle 6 may be angled in opposite directions such that each of the protrusions 5 is angled either toward or away from the middle 6. Alternatively, angle x may gradually increase or decrease for protrusions 5 closer or further away from the middle 6. In one embodiment, the protrusions 5 in closest proximity to the middle 6 may be approximately perpendicular to the side wall surfaces from which they extend, while protrusions 5 in closer proximity to the ends of the spacer key 1 may be angled toward the middle 6.

Figure 8:
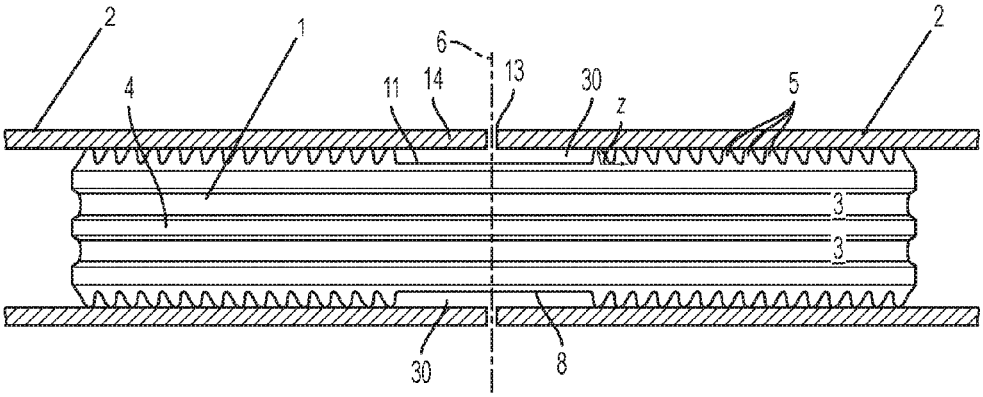
FIG. 8 is a top view of a spacer key in one embodiment of the invention inserted into a spacer section, showing protrusions flexed toward the center portion of the spacer key after assembly.

FIG. 8 shows a top view of a spacer key 1 in one embodiment of the invention that is inserted within two hollow spacer sections 2 at a splice joint 13. As shown, the protrusions 5 may be configured to flex toward the middle 6 after assembly. Depending on the starting angle prior to insertion within a spacer section 2, the degree of flexing may vary for individual protrusions 5. Certain protrusions 5 may flex such that the difference between angle x, prior to insertion, and angle z, after insertion, ranges from about 1 to about 179°, about 1 to about 150°, about 1 to about 90°, about 5 to about 80°, about 10° to about 70°, about 10° to about 60°, about 15° to about 50°, about 20° to about 40°, or about 25° to about 35°. The difference between angle x and angle z may be greater for protrusions 5 that extend greater distances from one or more side walls 8. Alternatively or in addition, the difference between angle x and angle z may be greater as the difference in widths between a spacer key 1 and its corresponding spacer section 2 decreases. The difference between angle x and angle z may increase for protrusions comprised of increasingly flexible materials, such as elastic polymers or rubbers. The protrusions 5 may be configured to restore angle x upon removal from one or more surrounding spacer sections 2. The protrusions 5 may be configured such that only a portion of each of the protrusions 5 flexes upon insertion into a spacer section 2. According to such an embodiment, the base of each of the protrusions 5 may remain stationary while portions further from the base, such as a tip portion, may flex. In other embodiments, the protrusions 5 may not flex upon insertion within one or more spacer sections 2, such as where a friction fit is used. Still other embodiments may feature protrusions 5 configured to flex only upon reaching a certain compressive force threshold exerted on the protrusions 2 after their insertion within one or more spacer sections 2.

Two depressed areas 11 are also shown in FIG. 8. The one or more depressed areas 11 may be positioned on one more external surfaces of one or more side walls 8. Lacking protrusions 5, the depressed areas 11 define an interstitial space 30 between the external surface of the spacer key 1 and the internal surface of one or more surrounding spacer sections 2 after assembly. FIG. 8 illustrates one embodiment of the lateral portion of the interstitial space 30 defined by the gap between the depressed areas 11, the internal surface of the side pieces 14, and the protrusions 5 at the splice joint 13.

After assembly, the contact between one or more internal surfaces of a spacer section 2 and the protrusions 5, as well as flexed angle z of the protrusions 5, creates resistance to the separation of adjoining spacer sections 2. Instead of digging into each spacer section 2, the material of the protrusions 5 may increase the coefficient of friction between the spacer key 1 and one or more surrounding spacer sections 2. Because the protrusions 5 may be flexed toward the middle 6 or compressed after assembly, the difference between the coefficient of static friction and kinetic friction between the spacer keys 1 and the spacer sections 2 may be substantially greater compared to spacer assemblies comprised of other materials and/or lacking similar protrusions.

Figure 9:
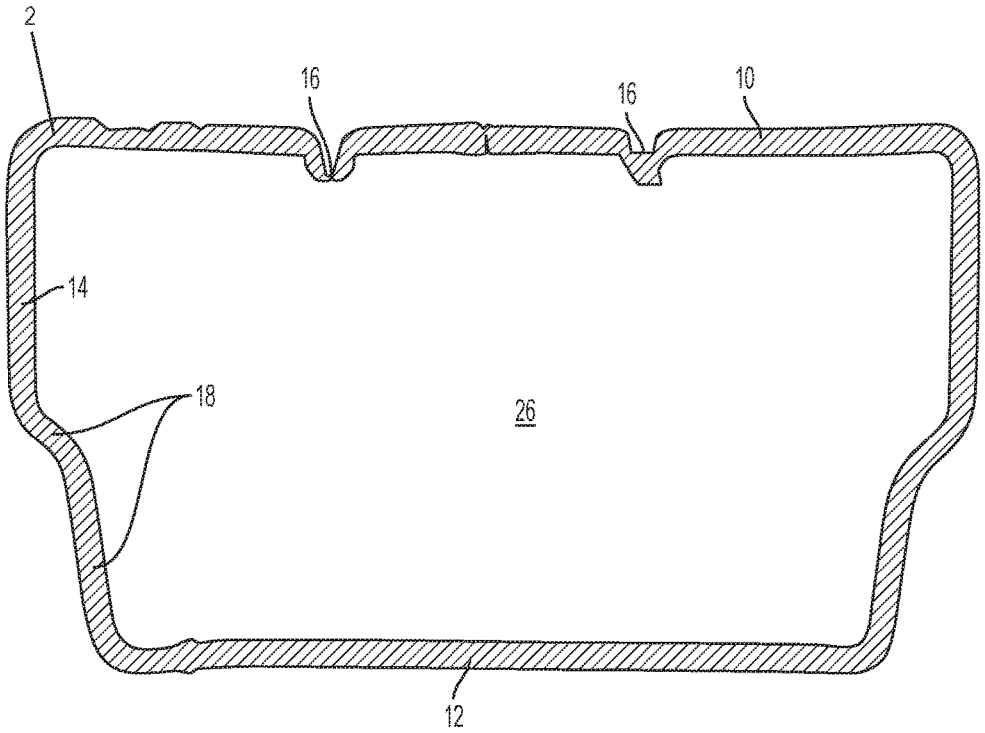
FIG. 9 is a cross-sectional view of a hollow spacer section with perforations extending inwardly from a top wall of a spacer key in one embodiment of the invention.

FIG. 9 depicts a cross-sectional view of the end of a spacer section 2 in one embodiment of the invention configured to receive one or more of the spacer keys 1 described herein. As shown, the spacer section 2 may feature one or more perforations 16 protruding inwardly from the top piece 10. The number of perforations 16 may vary, as well as the lateral distance between them. Tapered portions 18 extend inwardly from each of the side pieces 14, connecting to the bottom piece 12. The hollow space 26 is configured to receive one or more spacer keys 1 in slidable fashion.

The cross-sectional thickness of each of the top 10, side 14, and bottom 12 pieces may vary in different spacer sections as well as around the perimeter of a given spacer section 2. In some embodiments, the thickness may range from about 0.04 to about 0.30 mm, about 0.10 to about 0.20 mm, about 0.12 to about 0.18 mm, about 0.14 to about 0.16 mm, about 0.15 to about 0.45 mm, about 0.2 to about 0.5 mm, or about 0.3 to about 0.75 mm.

The angles formed between the various pieces comprising each spacer section 2 may also vary. In some embodiments, the angle formed between the top pieces and one or more side pieces may be less than, equal to, or greater than 90°. The angle formed between the tapered portion 18 and the bottom piece 12 may also be less than, equal to, or greater than 90°. The tapered portion 18 may extend laterally inward, as shown in FIG. 9, at various distances. Alternatively, the tapered portion 18 may extend laterally outward. The spacer section 2 may not comprise any tapered portion, instead featuring side pieces 14 extending from the top piece 10 straight to the bottom piece 12.

Figure 10:
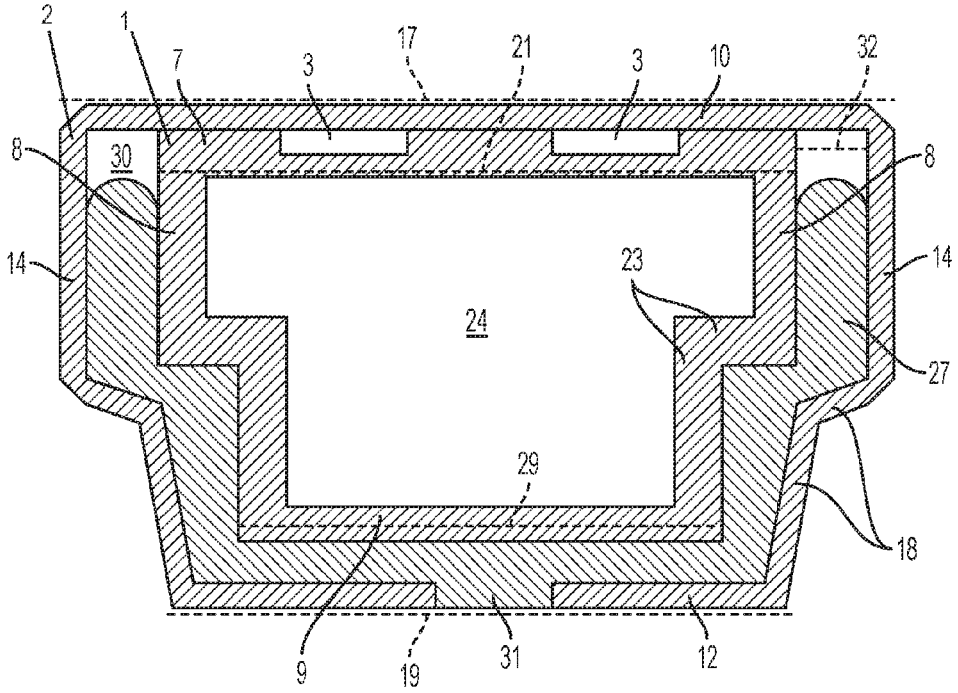
FIG. 10 is a cross-sectional view of an assembled spacer unit at a splice joint, showing a spacer key in one embodiment of the invention inserted within a spacer section and sealant material occupying the interstitial space between the spacer key and the surrounding spacer section.

FIG. 10 depicts an exemplary cross-sectional shape of a spacer key 1 and spacer section 2 in one embodiment of the invention at a point along the length of the key 1 lacking protrusions 5, for example, at a splice joint 13. As shown, the cross-sectional shape may be tubular, defining an interior hollow space 24. The spacer key 1 features a top wall 7, two side walls 8, and a bottom wall 9. The side walls 8 are arranged in opposition to each other and connect the top wall 7 to the bottom wall 9. The side walls 8 may extend in parallel fashion relative to each other and the spacer section side pieces 14, and may form an approximately perpendicular angle with respect to the edges of the top wall 7. To accommodate the tapered portion 18 on each side of the spacer section 2 and any added sealant material 27, one or more of the side walls 8 may each feature an inward indentation 23 that aligns with the tapered portion 18. Accordingly, the width 21 of the top wall 7 may be greater than the width 29 of the bottom wall 9. In alternative embodiments, not shown, the spacer key 1 may lack one or more indentations 23, such that the side walls 8 extend from the top wall 7 to the bottom wall 9. In such embodiments, widths 21 and 29 may be approximately equal, and the tubular cross-section of the spacer key 1 may be rectangular or square-shaped. In other embodiments lacking one or more indentations 23, the side walls 8 may angle inwardly as they extend away from the top wall 7 such that width 29 is shorter than width 21.

The configuration of the indentation 23 may vary. As shown, each indentation 23 comprises a rectangular cut-out portion that projects inwardly at an approximately perpendicular angle with respect to each of the side walls 8. In other embodiments, the indentation 23 may comprise a concaved curve. In still other embodiments, each indentation 23 may comprise an angled wall extending from the bottom of one of the side walls 8 to the nearest edge of the bottom wall 9.

Figure 11:
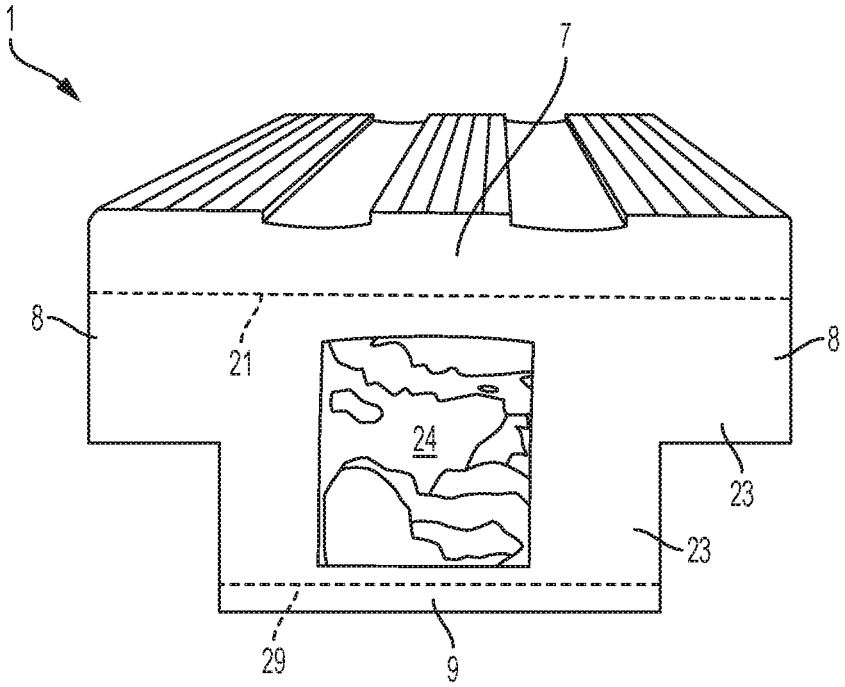
FIG. 11 is a cross-sectional view of the end of a spacer key in one embodiment of the invention.

The interior hollow space 24 defined by the walls of the spacer key 1 may span the length of the body 4 such that both ends of the spacer key 1 define a tubular cross section, as shown in a cross-sectional view of one end of the spacer key 1 in FIG. 11. The hollow space 24 may accommodate various granular or beaded desiccant materials, e.g., silica, molecular sieves, calcium oxide, clay, and/or calcium sulfate. Because both the spacer section 2 and the spacer key 1 inserted therein may feature a hollow cross-sectional design, desiccant materials 27 added to the hollow space 24 flows longitudinally through a plurality of spacer sections 2 and each spacer key 1 connecting them in an insulating glass unit 36. Thus, the hollow space 24 may serve as a channel for desiccant flow. The hollow, tubular design of the spacer key 1 maximizes desiccant volume and eases desiccant flow to maintain thorough dryness throughout the perimeter of each insulating glass unit 36. In alternative embodiments, the hollow space 24 may be partitioned into multiple internal hollow spaces by one or more additional, interior walls.

The cross-sectional dimensions of the spacer key 1 are limited by the cross-sectional dimensions of the surrounding spacer section 2. As shown in FIG. 10, the spacer key 1 is also sized such that an interstitial space 30 lies between the exterior of the spacer key 1 and the interior of the spacer section 2 at the splice joint 13 of an assembled spacer unit 35, where the body 4 preferably features one or more depressed areas 11 on one or more side walls 8. In one embodiment, the interstitial space 30 extends circumferentially around at least the side walls 8 and the bottom wall 9 of the spacer key 1. The difference between the width of the spacer key 1 and the spacer section 2 defines the cross-sectional width 32 of the interstitial space 30. By encompassing the middle 6 of the spacer key body 4, positioned longitudinally between the protrusions 5, the one or more depressed areas 11 align with the splice joint 13 of an assembled glass unit 35, where sealant material 27 is typically added. The protrusions 5 on either side of the one or more depressed areas 11 restrict movement of the sealant material 27 in a longitudinal direction. In alternative embodiments, the sealant material 27 may also be added or allowed to flow outside the one or more depressed areas 11.

Sealant material 27 added to the interstitial space 30 prevents moisture from entering the air space of the insulating glass unit 36 and/or prevents insulating gases, e.g., argon, from escaping the air space of the insulating glass unit 36. An injection process may be used to introduce sealant material 27 into the interstitial space 30 between the spacer key 1 and the surrounding spacer sections 2 of an assembled spacer unit 35, filling the volume defined by the one or more depressed areas 11 of the side walls 8, the interior surface of the surrounding spacer sections 2, and the protrusions 5. Injection processes may comprise drilling one or more holes 31 through the bottom piece 12 of a spacer section 2 and injecting a sealant material 27 therein. By drilling one or more holes 31 near the splice joint 13, between the protrusions 5, the sealant material 27 is able to fill the interstitial space 30 around the sides and bottom of the spacer key 1. A needle, nozzle, or other injection device may be used to inject sealant material 27 through one or more holes 31. Alternatively, sealant material 27 may be introduced near the one or more depressed areas just prior to connecting two adjacent spacer sections 2 during assembly.

The cross-sectional width of each of the walls comprising the spacer key 1 may vary to accommodate different spacer sections and/or modify the size of the interstitial space 30.

In some embodiments, width 21 of the top wall 7 may range from about 0.10 to about 1.45 inches, about 0.20 to about 1.20 inches, about 0.25 to about 1.0 inches, about 0.25 to about 0.35 inches, about 0.35 to about 0.40 inches, about 0.40 to about 0.45 inches, about 0.45 to about 0.55 inches, about 0.55 to about 0.60 inches, about 0.60 to about 0.65 inches, about 0.70 to about 0.80 inches, about 0.85 to about 0.90 inches, or about 0.95 to about 1.05 inches.

Similarly, the cross-sectional width 29 of the bottom wall 9 may also vary as necessary to fit within differently sized spacer sections and/or modify the size of the interstitial space 30. In some embodiments, width 29 may range from about 0.05 to about 1.45 inches, about 0.10 to about 1.20 inches, about 0.20 to about 1.0 inches, about 0.25 to about 0.35 inches, about 0.35 to about 0.40 inches, about 0.40 to about 0.45 inches, about 0.45 to about 0.55 inches, about 0.55 to about 0.60 inches, about 0.60 to about 0.65 inches, about 0.70 to about 0.80 inches, about 0.85 to about 0.90 inches, or about 0.95 to about 1.05 inches.

The cross-sectional height of each of the side walls 8 may also vary and may depend largely on the size of one or more indentations 23, if an indentation 23 is included. In one embodiment, each of the side walls 8 may range in height from about 0.05 to about 1.45 inches, about 0.10 to about 1.20 inches, about 0.20 to about 1.0 inches, about 0.25 to about 0.35 inches, about 0.35 to about 0.40 inches, about 0.40 to about 0.45 inches, about 0.45 to about 0.55 inches, about 0.55 to about 0.60 inches, about 0.60 to about 0.65 inches, about 0.70 to about 0.80 inches, about 0.85 to about 0.90 inches, or about 0.95 to about 1.05 inches.

In one embodiment, the thickness of the spacer key walls may vary at different points around the perimeter of the spacer key 1. For example, the thickness of the top wall 7 may be less around the longitudinal grooves 3, as shown in FIG. 10. The thickness may also be altered depending on the material comprising the spacer key 1. In embodiments where the material is more rigid, for example, the thickness of the spacer key walls may be decreased in comparison with embodiments where the key material is more flexible. In other embodiments, the thickness of the walls may be altered to modify the volume of the hollow space 24. For instance, in some embodiments a larger hollow space 24 may be desired to accommodate a greater amount of desiccant material and/or ease the desiccant flow from one spacer section to the next. According to such embodiments, the thickness of the spacer key walls may be thinned to increase the interior volume defined by the hollow space 24 without expanding the external dimensions of the spacer key 1. In addition or alternatively, the thickness of the spacer key walls may be thinned to increase the size of the interstitial space 30, thereby accommodating a greater volume of sealant material 27. In some embodiments, the thickness of the spacer key walls may range from about 0.10 to about 10 mm, about 0.50 to about 8 mm, about 1 to about 7 mm, about 2 to about 6 mm, or about 2 to about 5 mm.

In one embodiment, the spacer key 1 is comprised of one or more polymer materials and manufactured according to a molding process, e.g. injection molding. The one or more polymer materials preferably have low volatile content. In some embodiments, the spacer key may be comprised of one or more polymer compositions, biopolymer compositions, thermoplastics, rubbers, or metals. The hardness level of the materials used to comprise the spacer key 1 may vary. In some embodiments, the durometer measurement of the spacer key 1 may range from about 15 to about 100A, about 20 to about 90A, about 30 to about 75A, about 40 to about 70A, or about 50 to about 70A. In embodiments comprising one or more metals, the hardness level may range from about 30 HRB to about 70 HRC. The density of the materials used to comprise the spacer key 1 may also vary. In some embodiments, the density of the spacer key 1 may range from about 0.7 to about 1.6 g/cm$^3$, about 0.85 to about 1.45 g/cm$^3$, about 0.95 to about 1.3 g/cm$^3$, about 1.0 to about 1.2 g/cm$^3$, or about 1.05 to about 1.15 g/cm$^3$, or the density may be above or below these ranges. In other embodiments, such as those comprising one or more metals, the density may range from about 1.5 to about 8.5 g/cm$^3$, about 2.7 to about 8.2 g/cm$^3$, or about 7 to about 8.1 g/cm$^3$, or the density may be above or below these ranges. The materials comprising the spacer key 1 may also be colored as desired for aesthetic purposes. Colors may be chosen such as to match the color of the surrounding spacer sections.

FIG. 11 shows a cross-sectional view of the end of a spacer key 1 lacking protrusions 5 in one embodiment of the invention. The cross-sectional width of each of the side walls 8 may be greater than the cross-sectional width of each of the side walls in embodiments further comprising protrusions 5 positioned to extend from one or more side walls 8. The cross-sectional perimeter of the spacer key 1 may comprise sharply angled corners, with adjacent walls positioned perpendicularly with respect to each other. In other embodiments, one or more corners may be curved or angled as necessary to accommodate various spacer section designs and/or create additional gaps between the external surface of the spacer key 1 and the internal surface of one or more spacer sections 2. In embodiments lacking protrusions 5, such as that shown in FIG. 11, the spacer key 1 may be configured to flex or bend upon assembly, thereby compacting the body 4 toward the middle 6. In an embodiment, the spacer key 1 does not bend or flex, or does so minimally, and is held in place by friction. In other embodiments, spacer key 1 may be held in place by an adhesive or other material, alone or in combination with other methods disclosed herein. As further shown, the hollow space 24 may include various irregular protrusions or masses of spacer key material in some examples.

Figure 12:
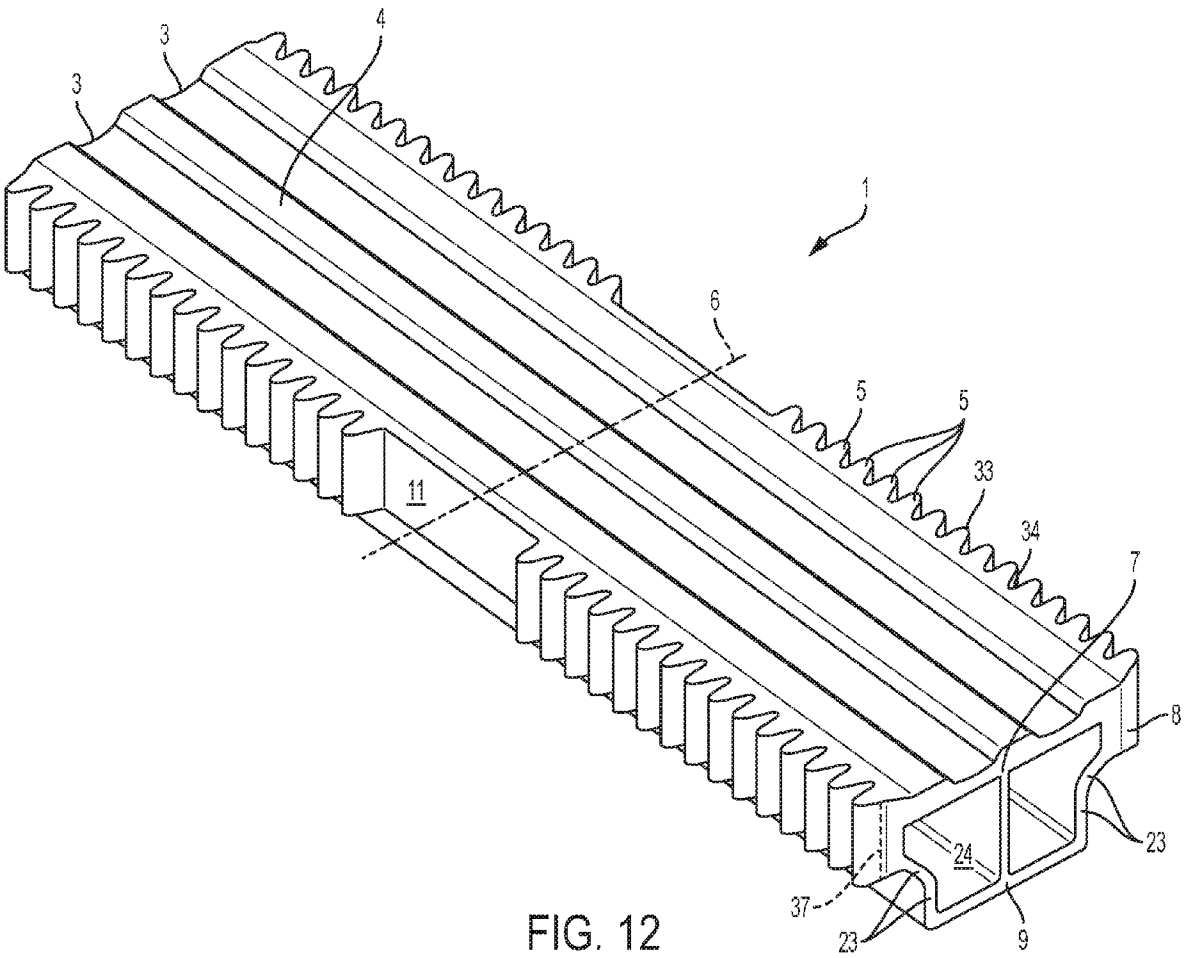
FIG. 12 is a perspective view of a spacer key in one embodiment of the invention, showing external features and tubular cross section.

FIG. 12 depicts a spacer key 1 in one embodiment of the invention. The width 37 of each of the protrusions 5 may span a portion of the height of each side wall 8 from which each of the protrusions 5 extends. In the embodiment shown, one side of the base 34 of each of the protrusions 5 is flush with the external surface of the top wall 7, and the other side is positioned at the uppermost point of indentation 23. The protrusions 5 may comprise various widths in additional embodiments. In one embodiment, width 37 may span only a portion of the vertical distance between the external surface of the top wall 7 and the indentation 23. In another embodiment, width 37 may extend from the top wall 7 to the bottom wall 9. The width of each protrusion 5 may remain constant or change as each protrusion 5 extends further from the surface of the body 4. In one embodiment, for instance, width 37 may narrow such that each of the protrusions 5 comprises an approximately triangular cross-sectional shape. The widths of the protrusions 5 may be equal or unequal within each row of protrusions 5. In other embodiments, multiple protrusions 5 may be positioned adjacent to each other within each row at equal distances from the middle 6. According to such embodiments, the combined width of the protrusions 5 may span the distance between the top wall 7 and the uppermost point of the indentation 23. In still other embodiments, the distance between the top wall 7 and the uppermost point of indentation 23 may not be covered by protrusions 5, which may be positioned in a scattered arrangement at various distances from each other.

Such an arrangement may be included in embodiments for which the protrusions 5 comprise various shapes, e.g., peg-like protuberances, bristles, or knobs.

The hollow space 24 may comprise various cross-sectional shapes and/or sizes. For example, the hollow space 24 may be approximately rectangular, square, circular, oval, or triangular. As shown in FIG. 12, the hollow space 24 may also be split into two adjacent hollow-spaces, divided by an interior partition. Alternatively, multiple partitions may be included to divide the hollow space 24 into multiple interior hollow spaces. Such partitions may comprise additional walls added to the hollow space 24, or holes drilled into the body 4. The number of interior hollow spaces may range from about 1 to about 16. Each hollow space may be shaped and/or sized differently or the same. Each hollow space may extend different longitudinal distances within the spacer key 1. Multiple hollow spaces may be used to compartmentalize different desiccant materials. Alternatively or in addition, the hollow space 24 may be connected to one or more intersecting transverse hollow spaces that extend laterally through the body 4 of each spacer key 1. The number of transverse hollow spaces may range from about 1 to about 20, and may comprise various cross-sectional widths. In other embodiments, one or more hollow spaces may comprise closed cavities. According to such embodiments, the cavities may be pre-filled with desiccant materials prior to assembly with one or more spacer sections.

While specific embodiments of the invention have been shown and described in detail to illustrate the application of the principles of the invention, it will be understood that the invention may be embodied otherwise without departing from such principles.

What is claimed is:

1. A spacer key for hollow spacer sections, the spacer key comprising:

a top wall and a bottom wall connected by opposing side walls such that the spacer key comprises a tubular cross-section and a longitudinally-extending body;

a plurality of laterally-outward extending protrusions positioned on one or more external surfaces of the opposing side walls;

one or more longitudinally-extending grooves on an external surface of the top wall; and one or more depressed areas positioned on one or more external surfaces of the opposing side walls, the one or more depressed areas being substantially flat and defined by an absence of and positioned between the laterally-outward extending protrusions, wherein the depressed areas overlap with a longitudinal middle of the spacer key, wherein the spacer key is configured for insertion within two adjacent hollow spacer sections, thereby connecting the two adjacent hollow spacer sections.

2. The spacer key of claim 1, wherein the one or more depressed areas are positioned such that after insertion within two adjacent hollow spacer sections, the one or more depressed areas align with a splice joint formed at an interface between two adjacent hollow spacer sections.

3. The spacer key of claim 2, wherein the one or more depressed areas define an interstitial space configured to receive a sealant material circumferentially between the spacer key and the interior of the two adjacent hollow spacer sections at the splice joint.

4. The spacer key of claim 1, wherein the one or more longitudinally-extending grooves extend the entire length of the longitudinally-extending body.

5. The spacer key of claim 4, wherein the one or more longitudinally-extending grooves are configured to accommodate outwardly-protruding perforations on one or more of the two adjacent hollow spacer sections.

6. The spacer key of claim 5, wherein the one or more longitudinally-extending grooves comprise two grooves.

7. The spacer key of claim 1, wherein the plurality of laterally-outward extending protrusions are configured to contact one or more internal surfaces of the two adjacent hollow spacer sections such as to increase a frictional force between the one or more internal surfaces of the hollow spacer sections and the plurality of laterally-outward extending protrusions.

8. The spacer key of claim 7, wherein the plurality of laterally-outward extending protrusions are configured to flex or bend toward the longitudinal middle of the spacer key upon insertion of the spacer key into each of the two adjacent hollow spacer sections.

9. The spacer key of claim 8, wherein the plurality of laterally-outward extending protrusions are uniformly sized.

10. The spacer key of claim 8, wherein the plurality of laterally-outward extending protrusions are progressively longer or shorter with increasing distance from the longitudinal middle.

11. The spacer key of claim 8, wherein the plurality of laterally-outward extending protrusions are configured to extend at about a perpendicular angle with respect to the one or more external surfaces of the opposing side walls.

12. The spacer key of claim 11, wherein the plurality of laterally-outward extending protrusions each comprise a base portion and a tip portion, such that the base portion has a greater thickness than the tip portion.

13. The spacer key of claim 12, wherein the base portion of each laterally-outward extending protrusion extends from the top wall to an indentation on one of the one or more external surfaces of the opposing side walls.

14. The spacer key of claim 1, wherein the plurality of laterally-outward extending protrusions comprises ribs arranged in one or more longitudinally-extending rows.

15. The spacer key of claim 14, wherein each of the one or more longitudinally-extending rows spans a portion of the length of the longitudinally-extending body.

16. The spacer key of claim 14, wherein each of the one or more longitudinally-extending rows spans the entire length of the longitudinally-extending body.

17. The spacer key of claim 1, wherein the tubular cross section of the spacer key defines an internal hollow space configured to receive one or more desiccant materials.

18. The spacer key of claim 17, wherein the internal hollow space comprises a channel that extends the entire length of the longitudinally-extending body.

* * * * *